US007046954B2

(12) United States Patent
Yokoi

(10) Patent No.: US 7,046,954 B2
(45) Date of Patent: May 16, 2006

(54) RECORDING APPARATUS AND METHOD FOR DISCRIMINATING TYPE OF RECORDING MEDIUM

(75) Inventor: Katsuyuki Yokoi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 10/877,605

(22) Filed: Jun. 25, 2004

(65) Prior Publication Data

US 2005/0002711 A1 Jan. 6, 2005

(30) Foreign Application Priority Data

Jul. 4, 2003 (JP) ..... 2003-191930
May 7, 2004 (JP) ..... 2004-139049

(51) Int. Cl.
*G03G 15/00* (2006.01)

(52) U.S. Cl. ..... 399/389; 399/388

(58) Field of Classification Search ..... 399/389, 399/388; 400/708, 582; 271/8.1, 110
See application file for complete search history.

(56) References Cited

U.S. PATENT DOCUMENTS

| | | | | |
|---|---|---|---|---|
| 5,734,405 | A | 3/1998 | Suzuki | |
| 6,176,481 | B1 * | 1/2001 | Ohkoda | 271/9.05 |
| 6,217,168 | B1 * | 4/2001 | Elgee | 347/105 |
| 6,291,829 | B1 * | 9/2001 | Allen et al. | 250/559.07 |
| 6,390,703 | B1 * | 5/2002 | Kinas et al. | 400/708 |
| 6,718,145 | B1 * | 4/2004 | Ohta et al. | 399/16 |
| 2004/0008244 | A1 * | 1/2004 | Tsujimoto | 347/105 |

* cited by examiner

*Primary Examiner*—Anthony H. Nguyen
(74) *Attorney, Agent, or Firm*—Canon U.S.A. Inc IP Division

(57) ABSTRACT

A recording apparatus having a discriminating unit for discriminating the type of a recording medium loaded on a loading unit. The discriminating unit discriminates the type of a subsequent recording medium responsive to the previous recording medium being fed by a predetermined length during recording of the previous recording medium. The recording apparatus also includes a sensor for detecting the trailing edge of the recording medium. The recording apparatus confirms whether image data for recording on the subsequent recording medium is stored before or after detection of the trailing edge of the previous recording medium.

19 Claims, 8 Drawing Sheets

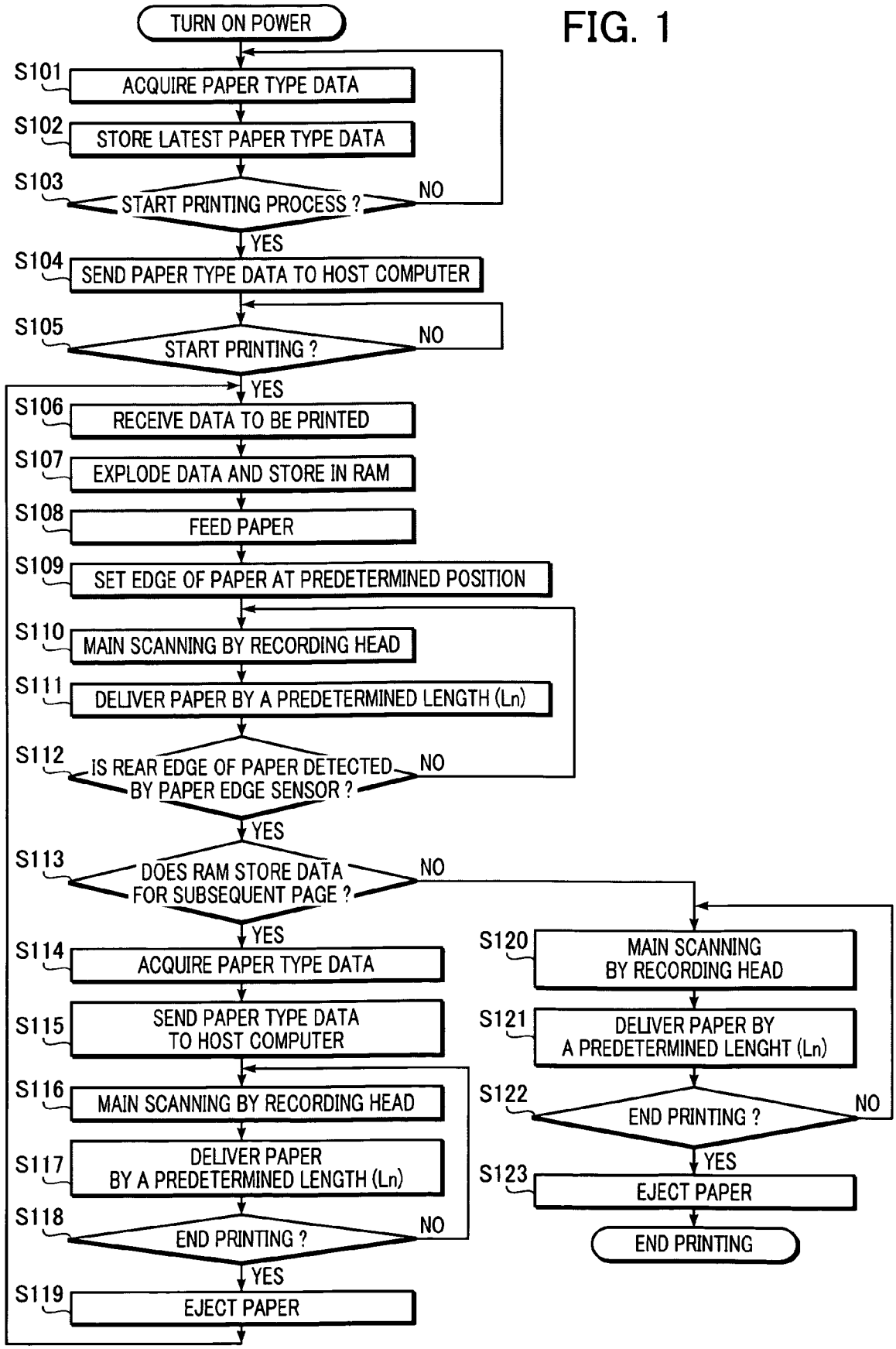
FIG. 1
TURN ON POWER
S101
ACQUIRE PAPER TYPE DATA
S102
STORE LATEST PAPER TYPE DATA
S103
START PRINTING PROCESS ?
NO
YES
S104
SEND PAPER TYPE DATA TO HOST COMPUTER
S105
START PRINTING ?
NO
YES
S106
RECEIVE DATA TO BE PRINTED
S107
EXPLODE DATA AND STORE IN RAM
S108
FEED PAPER
S109
SET EDGE OF PAPER AT PREDETERMINED POSITION
S110
MAIN SCANNING BY RECORDING HEAD
S111
DELIVER PAPER BY A PREDETERMINED LENGTH (Ln)
S112
IS REAR EDGE OF PAPER DETECTED BY PAPER EDGE SENSOR ?
NO
YES
S113
DOES RAM STORE DATA FOR SUBSEQUENT PAGE ?
NO
YES
S114
ACQUIRE PAPER TYPE DATA
S115
SEND PAPER TYPE DATA TO HOST COMPUTER
S116
MAIN SCANNING BY RECORDING HEAD
S117
DELIVER PAPER BY A PREDETERMINED LENGTH (Ln)
S118
END PRINTING ?
NO
YES
S119
EJECT PAPER
S120
MAIN SCANNING BY RECORDING HEAD
S121
DELIVER PAPER BY A PREDETERMINED LENGHT (Ln)
S122
END PRINTING ?
NO
YES
S123
EJECT PAPER
END PRINTING

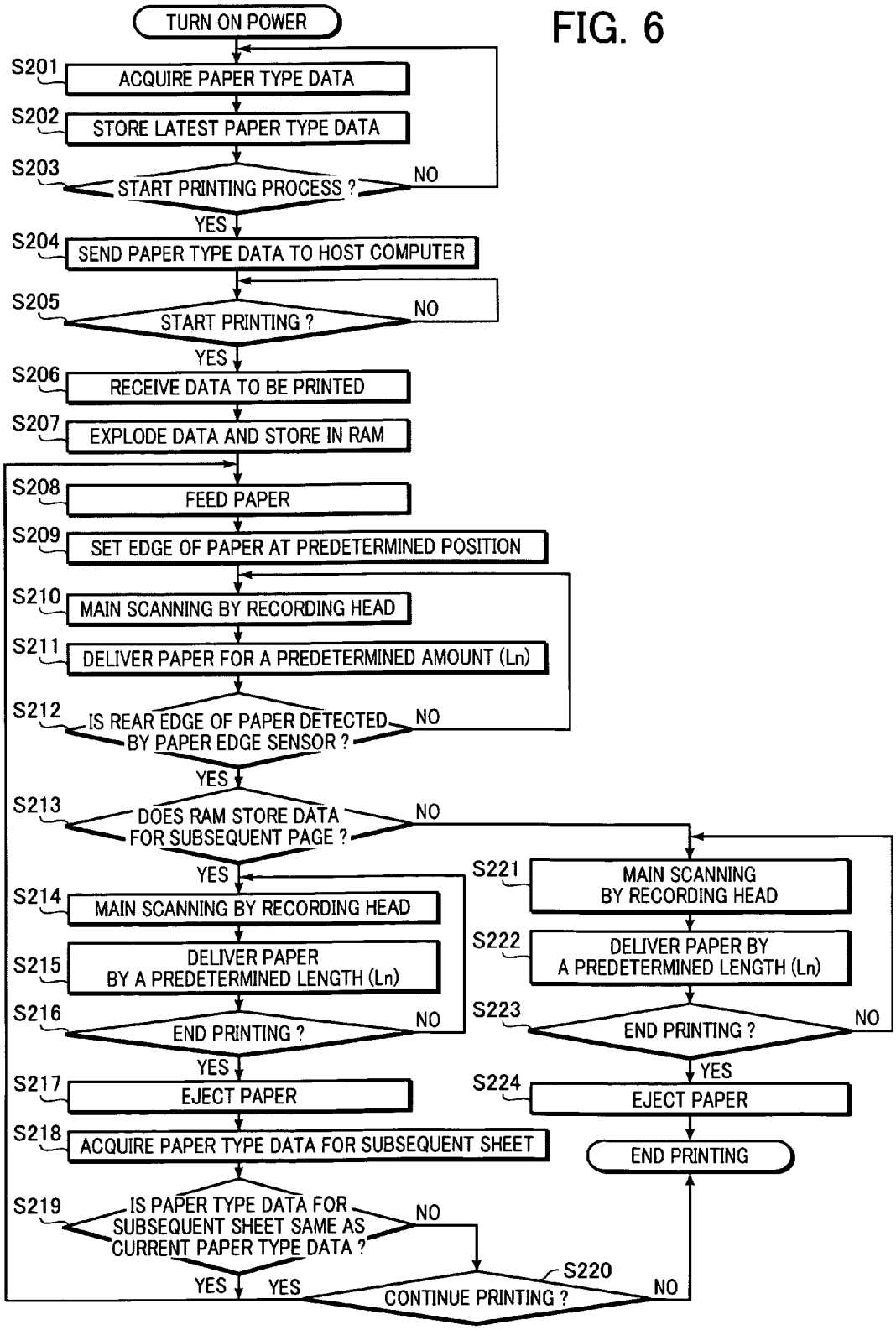
FIG. 6
TURN ON POWER
S201
ACQUIRE PAPER TYPE DATA
S202
STORE LATEST PAPER TYPE DATA
S203
START PRINTING PROCESS ?
NO
YES
S204
SEND PAPER TYPE DATA TO HOST COMPUTER
S205
START PRINTING ?
NO
YES
S206
RECEIVE DATA TO BE PRINTED
S207
EXPLODE DATA AND STORE IN RAM
S208
FEED PAPER
S209
SET EDGE OF PAPER AT PREDETERMINED POSITION
S210
MAIN SCANNING BY RECORDING HEAD
S211
DELIVER PAPER FOR A PREDETERMINED AMOUNT (Ln)
S212
IS REAR EDGE OF PAPER DETECTED BY PAPER EDGE SENSOR ?
NO
YES
S213
DOES RAM STORE DATA FOR SUBSEQUENT PAGE ?
NO
YES
S214
MAIN SCANNING BY RECORDING HEAD
S215
DELIVER PAPER BY A PREDETERMINED LENGTH (Ln)
S216
END PRINTING ?
NO
YES
S217
EJECT PAPER
S218
ACQUIRE PAPER TYPE DATA FOR SUBSEQUENT SHEET
S219
IS PAPER TYPE DATA FOR SUBSEQUENT SHEET SAME AS CURRENT PAPER TYPE DATA ?
NO
YES
YES
S220
CONTINUE PRINTING ?
NO
S221
MAIN SCANNING BY RECORDING HEAD
S222
DELIVER PAPER BY A PREDETERMINED LENGTH (Ln)
S223
END PRINTING ?
NO
YES
S224
EJECT PAPER
END PRINTING

RECORDING APPARATUS AND METHOD FOR DISCRIMINATING TYPE OF RECORDING MEDIUM

CROSS REFERENCE TO RELATED APPLICATIONS

This application claims the benefit of Japanese Application 2003-191930, filed Jul. 4, 2003, and Japanese Application 2004-139049, filed May 7, 2004, the entire contents of which are incorporated herein by reference.

BACKGROUND OF THE INVENTION

1. Field of the Invention

The present invention relates to a recording apparatus, such as a printer, a copier, or a facsimile.

2. Description of the Related Art

For a known recording apparatus using a recording medium for recording, various types of recording media such as plain paper, OHP paper, or glossy paper may be used. When recording, the recording conditions for a recording unit are usually changed in accordance with the type of recording medium.

Small recording apparatuses typically used in households allow only a small quantity of recording media to be loaded on a loading unit at a time. Such apparatuses have a feeding unit that is capable of feeding various types of recording medium. For such a small-size apparatus, data is recorded only on a limited number of recording media in one recording action. This kind of recording apparatus is convenient for a user who wants to use various types of recording media since the recording media loaded in the loading unit can be easily changed with frequency.

The above-mentioned recording apparatus does not generally include means for identifying a type of recording medium. Instead, the user has to input the recording medium type into an output device, such as a host computer, which then sends data on the recording medium type to the recording apparatus.

Since there are various types of recording media, it is difficult for the user to recognize every type of recording media and input the correct recording medium type. Furthermore, the process for inputting the data on the recording medium type is complicated. For these reasons, for recording apparatuses, including relatively small-size recording apparatuses not using cassettes, a mechanism for automatically identifying the recording medium type has been proposed. For such a recording apparatus, it is not known whether or not the recording medium on the loading unit will be actually used for recording during the period between power up of the recording apparatus and start of recording. Therefore, it is difficult to decide when to identify the recording medium type in the loading unit.

As a method for automatically identifying the type of recording medium for known small-size recording apparatuses, U.S. Pat. No. 5,734,405 (Japanese Patent Laid-Open No. 6-340166) discloses a method for acquiring data on the recording medium type by using a recording medium-type identifying unit while the recording medium is delivered through the recording apparatus. In this case, the recording medium-type identifying unit is mounted on the path of the recording medium, which extends from the loading unit to the position where recording is carried out by a recording unit. In this way, the recording medium type is identified by the detecting unit while the recording medium is delivered through the recording apparatus.

FIG. 7 is a flow chart describing a conventional method for identifying type of recording medium. When the recording apparatus is turned on, a controller in the recording apparatus, such as a CPU, waits for a recording command to be sent from a data output device, such as a host computer (i.e., the controller waits for the printing process to be started) (S601). The data output device sends data to be recorded to the recording apparatus (S602 and S603). Then, the recording apparatus begins feeding the recording medium (S604). When an edge sensor detects a leading edge of the recording medium (S605), the leading edge of the recording medium is set at a start position for recording (S606). Subsequently, the recording medium-type identifying unit mounted on a main scanning unit (carriage) for moving the recording unit in the main scanning direction acquires the data on the recording medium type (S607). Finally, based on this acquired data, recording conditions corresponding to the type of recording medium are selected and recording begins (S608).

When a document to be recorded includes a plurality of pages, such recording apparatus simply repeats the recording sequence described in FIG. 6 (i.e., feeding the recording medium, acquiring data on the recording medium type by the recording-medium type identifying unit, and selecting the recording conditions) for each page of the document. The recording medium-type identifying unit only identifies medium type for the first recording medium and not for subsequent media. The recording apparatus assumes that all pages of the same document will be recorded on the same type of recording medium and that the same type of recording medium will be fed from the loading unit.

FIG. 8 is a flow chart describing control of a known recording apparatus in which steps for identifying type of recording medium used for recording a second and subsequent pages of the document are omitted.

The process for recording the first page of the document is the same as described in FIG. 7 (S701 to S710). Even if data for the next document page is received (S711), the recording medium type for the next document page is not identified and the page is printed (S712 to S717).

The above-mentioned recording apparatus has the following problems.

In the method disclosed in U.S. Pat. No. 5,734,405 (Japanese Patent Laid-Open No. 6-340166), data on the recording medium type is sent from the host computer after recording is started. Therefore, the total amount of time required from the beginning to the end of recording becomes relatively long, reducing throughput. Moreover, when a multi-page document is printed using a recording apparatus that acquires data on the medium type for each page of the document, the time required for the entire recording process is significantly increased.

For a recording apparatus that acquires data on the recording medium type for only the first recording medium even though the document includes a plurality of pages, the second and subsequent pages of the document are recorded according to the conditions-selected for the first page. Recording is carried out according to the same conditions even when there is not enough of the same type of recording media loaded for recording all pages of the document. For this reason, when recording is carried out on a second or subsequent recording medium that is a different type of recording medium compared to the first recording medium, the feeding action might become unstable, resulting in unsatisfactory recording.

SUMMARY OF THE INVENTION

The present invention is directed to a recording apparatus that can be easily used by limiting the time required for acquiring data on the type of recording medium and by taking full advantage of the acquired data to carry out highly reliable recording. The recording apparatus includes a loading unit for loading a recording medium, a feed unit for feeding the recording medium loaded on the loading unit, and a recording unit for recording an image on the recording medium fed by the feed unit. The present invention is also directed to a method for operating the recording apparatus.

In one aspect of the present invention, the recording apparatus includes a discriminating unit for discriminating a type of the recording medium, wherein the discriminating unit discriminates the type of a second recording medium after a predetermined length of a first recording medium is fed by the feed unit. In one embodiment, the discriminating unit discriminates the type of the second recording medium while the recording unit records on the first recording medium. The type of recording medium to be used for recording subsequent pages of the document is identified before the recording of the previous page is completed. In this way, throughput is not reduced and the recording may be carried out suitably for the recording medium type. In another embodiment, the discriminating unit discriminates the type of the second recording medium after the recording unit records on the first recording medium, and the type of the second recording unit is compared with the type of the first recording medium. If the types are not the same, the user is alerted.

In another aspect of the present invention, the recording apparatus includes a sensor for detecting a trailing edge of the recording medium. In one embodiment, the recording apparatus confirms whether image data for recording on a subsequent recording medium is stored responsive to the sensor detecting the trailing edge of a previous recording medium. In another embodiment, the recording apparatus confirms whether image data for recording on a subsequent recording medium is stored before the sensor detects the trailing edge of the previous recording medium.

By fully utilizing the data on the recording medium type for feeding the recording medium and delivering the recording medium and for expanding the data, highly reliable recording suitable for the recording medium type is carried out.

Further features and advantages of the present invention will become apparent from the following description of the embodiments with reference to the attached drawings.

BRIEF DESCRIPTION OF THE DRAWINGS

FIG. 1 is a flow chart describing the control of an embodiment of a recording apparatus according to the present invention.

FIG. 6 is a flow chart describing the recording of a second embodiment of the present invention.

DESCRIPTION OF THE PREFERRED EMBODIMENTS

First Embodiment

A first embodiment of the present invention will be described with reference to FIGS. 1 to 5.

Figure 2:
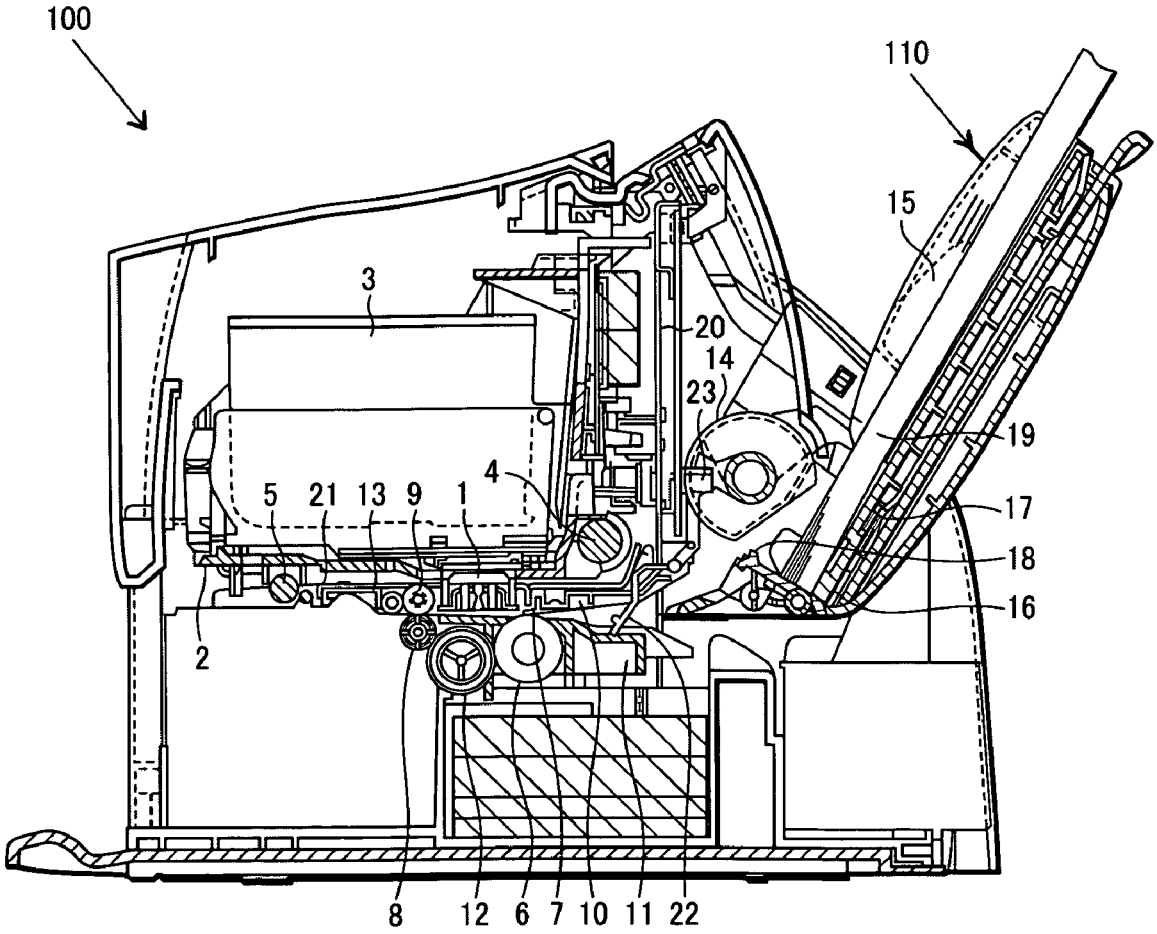
FIG. 2 is a longitudinal cross-sectional view of an embodiment of the recording apparatus according to the present invention illustrated in FIG. 1.
Figure 3:
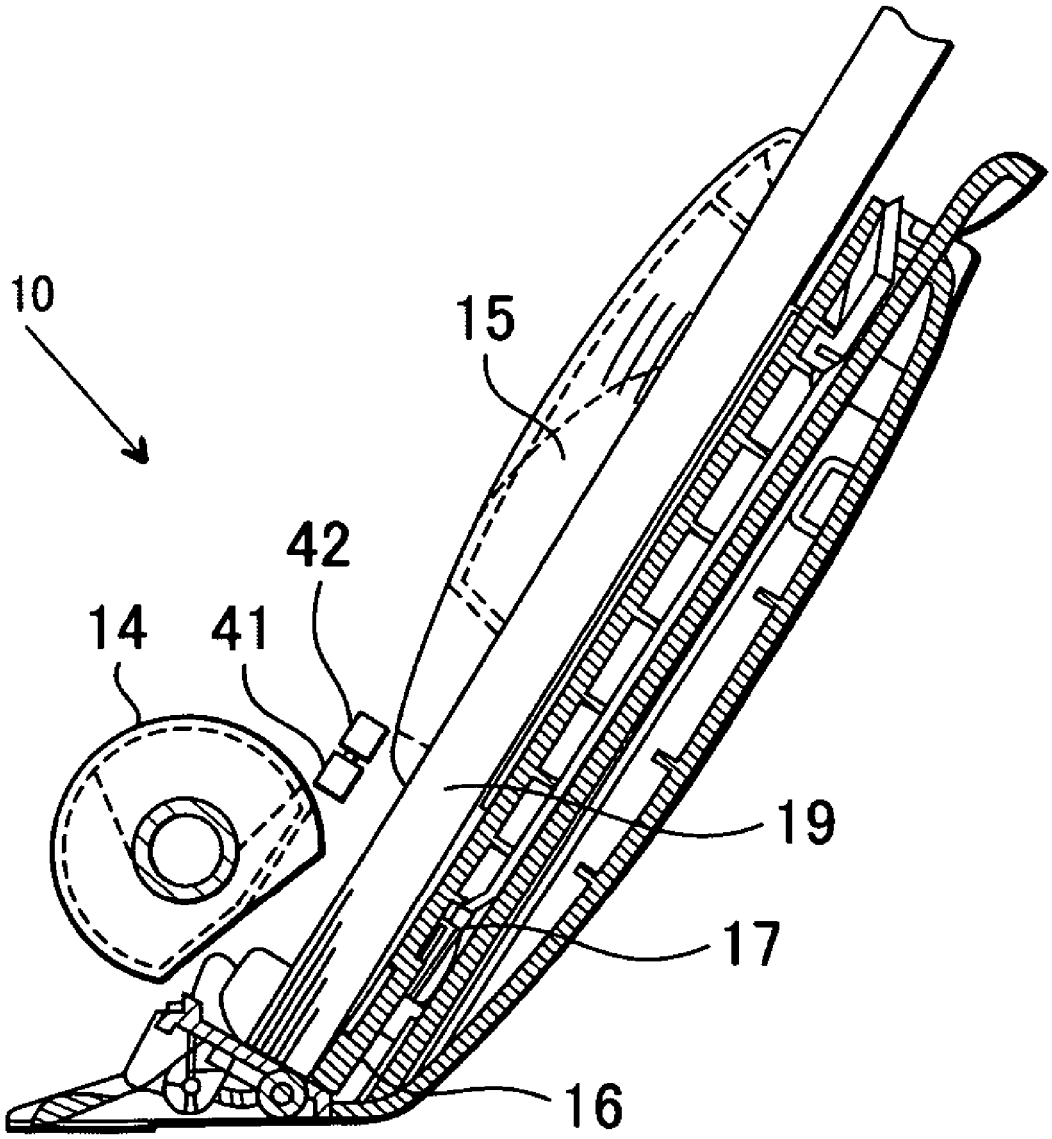
FIG. 3 is a longitudinal cross-sectional view of a loading unit of the recording apparatus illustrated in FIG. 1.

FIG. 2 is a longitudinal cross-sectional view of a recording apparatus 100 in accordance with a first embodiment of the present invention. FIG. 3 is a longitudinal cross-sectional view of a feeding unit 110 of the recording apparatus 100 shown in FIG. 1.

In FIG. 2, an inkjet recording head 1 is for recording data on a recording medium. The inkjet recording head 1 is mounted on a carriage 2 that moves in a main scanning direction. An ink tank 3 is for supplying ink to the inkjet recording head 1 mounted on the carriage 2. Carriage axes 4 and 5 guide the carriage 2 during the main scanning. A first delivery roller 6 for delivering the recording medium is disposed upstream of a delivering direction to a recording region where data is recorded on the recording medium by the inkjet recording head 1. A first driven roller 7 is disposed opposite the first delivery roller 6. A first driven roller holder 10 holds the first driven roller 7. A second delivery roller 8 for delivering the recording medium is disposed downstream of the recording region. A second driven roller 9 is disposed opposite the second delivery roller 8. A delivery roller holder 11 holds the first delivery roller 6 by being engaged with the central axis of the first delivery roller 6. A transmitting roller 12 transmits the driving force of the first delivery roller 6 to the second delivery roller 8 by urging the first delivery roller 6 and the second delivery roller 8 with a spring (not depicted in the drawing). A second driven roller holder 13 holds the second driven roller 9. A feed roller 14 feeds the recording medium to the first delivery roller 6. A stacker 15 is for stacking the recording media to be used for recording. A pressure plate 16 urges the recording media loaded on the stacker 15 outwards by an elastic force of a spring 17. A separation claw 18 separates one recording medium from the stack of recording media in the stacker 15 so that the recording medium can be fed into the recording apparatus 100. A loading unit 110 includes the following components: the feed roller 14, the stacker 15, the pressure plate 16, the spring 17, and the separation claw 18. The recording apparatus 100 also includes the recording medium 19, a chassis 20, a holding plate 21 for holding the first driven roller holder 10 and the second driven roller holder 13. An edge detecting lever 22 moves when leading and trailing edges of a recording medium 19 delivered by the feed roller 14 pass by. An edge sensor 23 such as an optical sensor detects the edge of the recording medium 19 passing through by detecting movement of the edge detecting lever 22 and changes this movement into an electrical signal. The edge detecting lever 22 is disposed upstream of the recording region of the inkjet recording head 1 illustrated in FIG. 1.

The feeding unit 110 illustrated in FIG. 3 includes a recording medium sensor (recording medium detecting unit) 41 for detecting whether or not the recording medium 19 has been loaded and a recording medium-type sensor (recording medium-type identifying unit) 42 for identifying/discriminating the type of recording medium 19 loaded on the stacker 15. These sensors 41 and 42 can be optical sensors.

For example, a reflective optical sensor may be used as the recording medium sensor (recording medium detecting unit) 41. When using a reflective optical sensor, a hole is opened in a position on the pressure plate 16 opposing the recording medium sensor (recording medium detecting unit) 41. In this way, when the recording medium 19 is not loaded, light emitted from the optical sensor does not return, and, thus, a receiver of the optical sensor does not detect the light. On the other hand, when the recording medium 19 is loaded, the light emitted from the optical sensor is reflected on the surface of the recording medium and returns to the optical sensor, causing the receiver of the optical sensor to detect the light. Accordingly, whether or not the recording medium is loaded can be detected according to whether or not the receiver detects the reflected light.

The recording medium-type sensor 42 may also be a reflective optical sensor. The different types of recording media 19 such as plain paper, glossy paper and OHP paper are each composed of different materials and have different surface conditions. As such, when light of the same intensity is emitted onto the surfaces of the recording medium, the intensity of the reflected light differs depending on the type of recording medium. Thus, the type of recording medium can be identified by reading (analog) the reflective level of the light by the reflective optical sensor and compare the reflective level with predetermined levels acquired through experiments.

Figure 4:
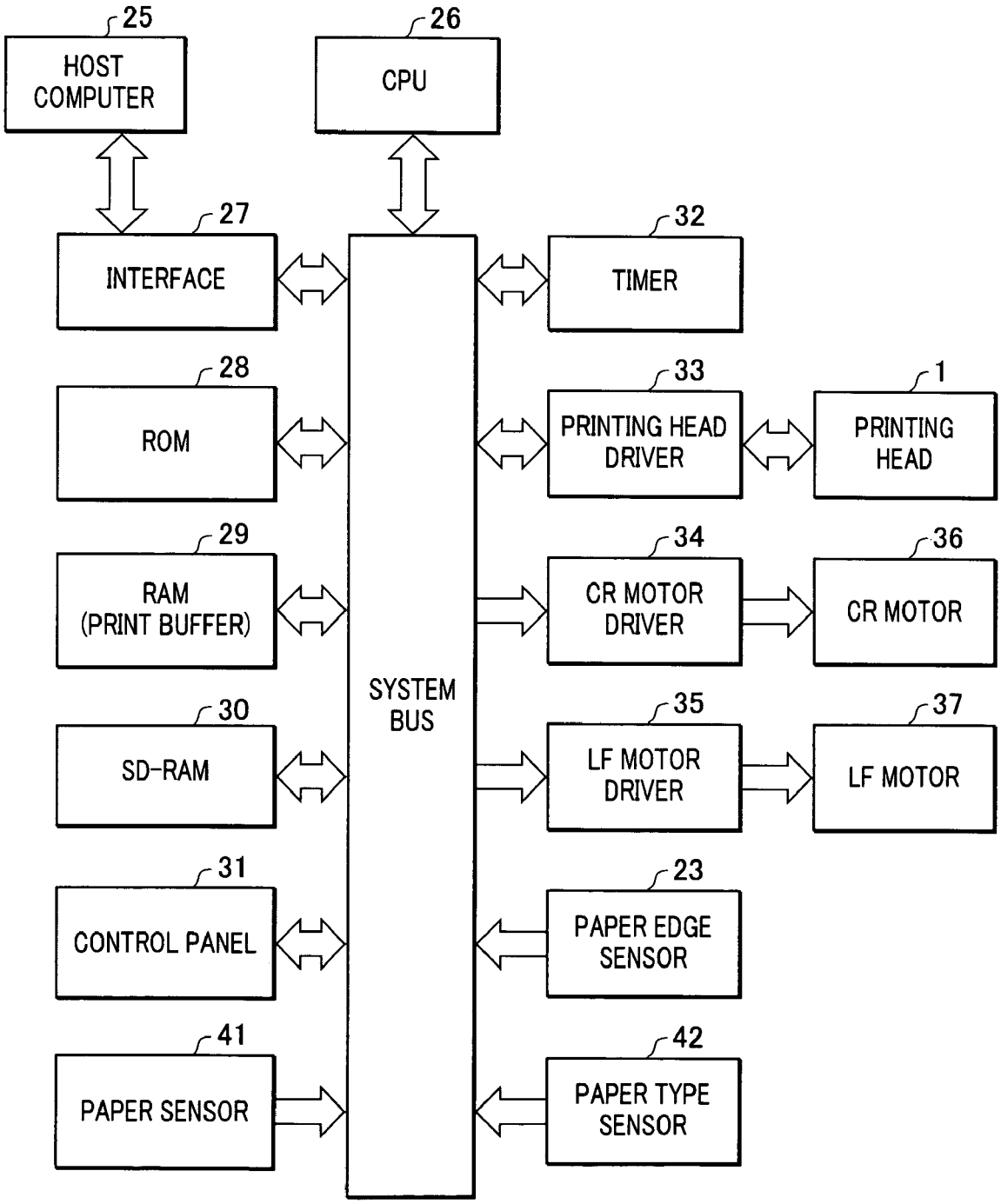
FIG. 4 is a block diagram describing the structure of the control system of the recording apparatus illustrated in FIG. 1.

FIG. 4 is a block diagram of a system for controlling each component of the recording apparatus 100 shown in FIG. 1.

In FIG. 4, a CPU 26, such as a microprocessor, is connected to a host computer 25 via an interface 27. The CPU 26 functions as controlling unit for controlling the recording according to the data to be recorded, which is stored in a ROM (program memory) 28 or a RAM (buffer memory) 29 included in the host computer 25. A SD-RAM 30 can be RAM included in the control system for storing data that can be rewritten. Alternatively, the SD-RAM 30 can be a NVRAM, which is a nonvolatile memory capable of storing data even after the power is turned off. The control system also includes a control panel 31 for user input of various data and commands and a timer 32.

The CPU 26 receives detection signals from the edge sensor 23, the recording medium sensor 41, and the recording medium-type sensor 42. The CPU 26 controls a CR motor 36 and an LF motor 37 via motor drivers 34 and 35 in accordance with various input data such as the detection signals. The CPU 26 also controls the inkjet recording head 1 via a head driver 33 in accordance with the data to be recorded stored in the RAM 29.

The controlling actions of the recording apparatus 100 having the above-mentioned structure will be described with reference to the flow chart in FIG. 1.

When the power of the recording apparatus 100 is turned on, data on the type of recording medium 19 loaded on the stacker 15, i.e., loading unit 110, is acquired by the recording medium-type sensor 42 (S101). This data is stored in the RAM 30 (S102). Then, the recording apparatus 100 maintains a standby mode until the host computer 25 sends a recording signal. In the standby mode, the steps S101 and S102 are repeated. In this way, if the user adds more recording media to the stacker 15 after the power has been turned on, the data on the recording medium type is always updated. The recording apparatus 100 can be configured so that while the steps S101 and S102 are repeated, the data on the recording medium type is written onto the RAM 30 only when the recording medium-type sensor 42 detects that the recording medium type has changed compared to the recording medium type detected in the previous Step S101.

When an application installed on the host computer 25 starts the printing process, the most newly acquired data on the type of recording medium is sent from the recording apparatus 100 to the host computer 25 (S104). For example, when a user opens a printing dialog box of the application to start printing, this action is notified to the CPU 26 via the interface 27. Then, the CPU 26 accepts this as the beginning of the printing process (S103) and sends the current recording medium-type data stored in the RAM 30 (S104). The recording medium-type data sent to the host computer 25 is used in the printing carried out subsequently for data processing such as disposing dots in a manner suitable for the recording medium loaded on the loading unit 110.

After the user sets and confirms the printing conditions through the print dialog box, a printing command can be outputted by pressing the print button (S105). Then, the data to be recorded is sent from the host computer 25 to the recording apparatus 100 and printing begins, as described below.

In the printing process, the recording apparatus 100 first receives the data to be recorded from the host computer 25 (S106). Then, the data is transformed into command data for the recording apparatus 100 to perform recording and is stored in the RAM 29 (S107).

Subsequently, the recording medium 19 loaded on the stacker 15 is fed one at a time by the feed roller 14 (S108). To achieve a highly reliable feeding action, an optimal value for the recording conditions such as the recording speed must be selected in accordance with the recording medium type. Accordingly, an optimal condition is selected from the feeding conditions stored in the ROM 28 according to the recording medium-type data stored in the RAM 30. Then, the recording medium 19 is fed according to the conditions such as the feeding speed (S108). Subsequently, based on the data acquired by the edge sensor 23, the recording medium 19 is set at the position where the ink-jet recording head 1 starts recording (S109). Then, the data optimized according to the recording medium-type data is recorded on the recording medium 19.

During the recording process, the data is recorded on the recording medium 19 by the recording head 1(S110) moving in the main scanning direction. Also, a predetermined length of the recording medium 19 in which the data is being recorded is delivered further (S111). Steps S110 and S111 are repeated.

Figure 5:
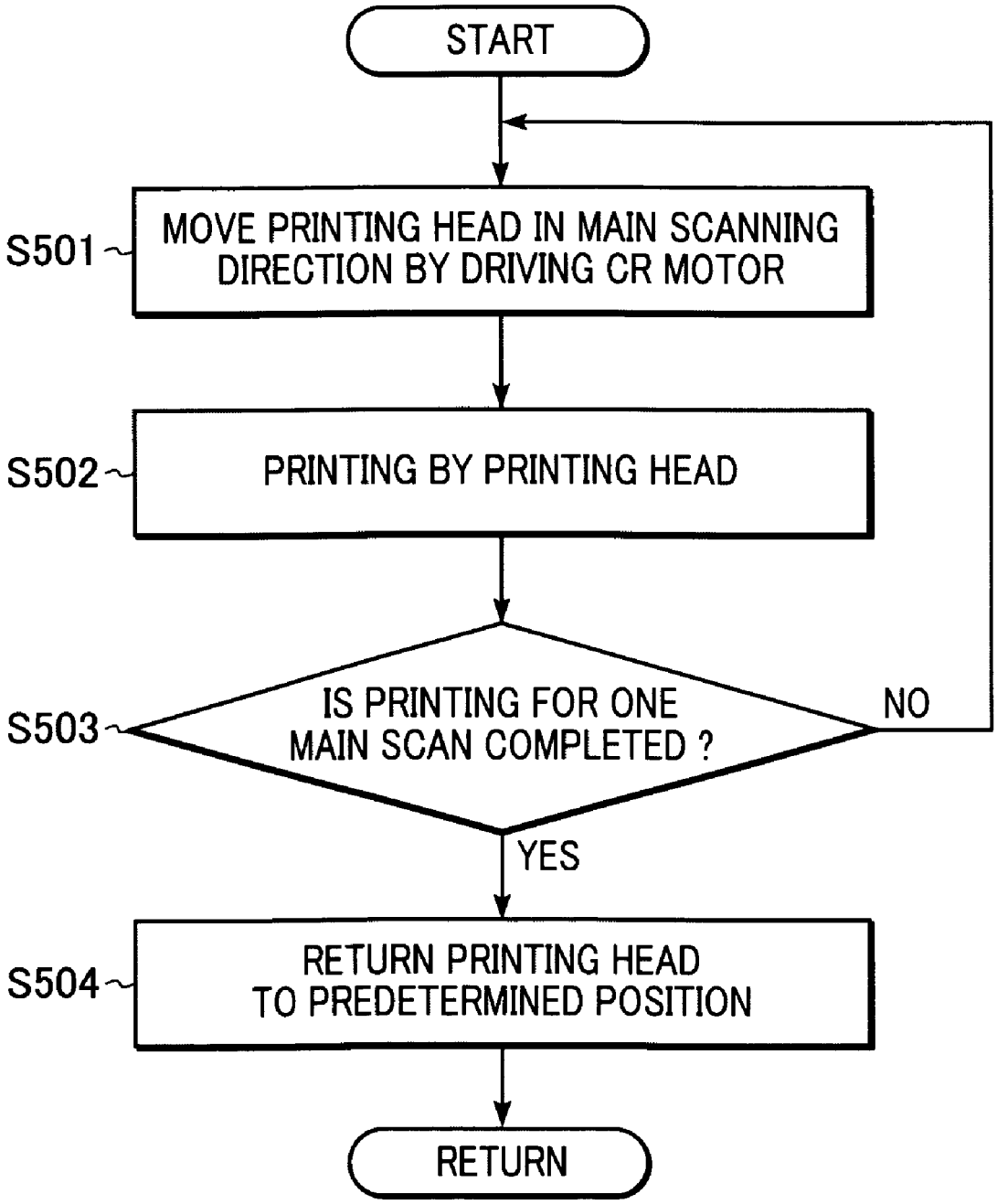
FIG. 5 is a flow chart describing the recording of a first embodiment of the present invention.
Figure 7:
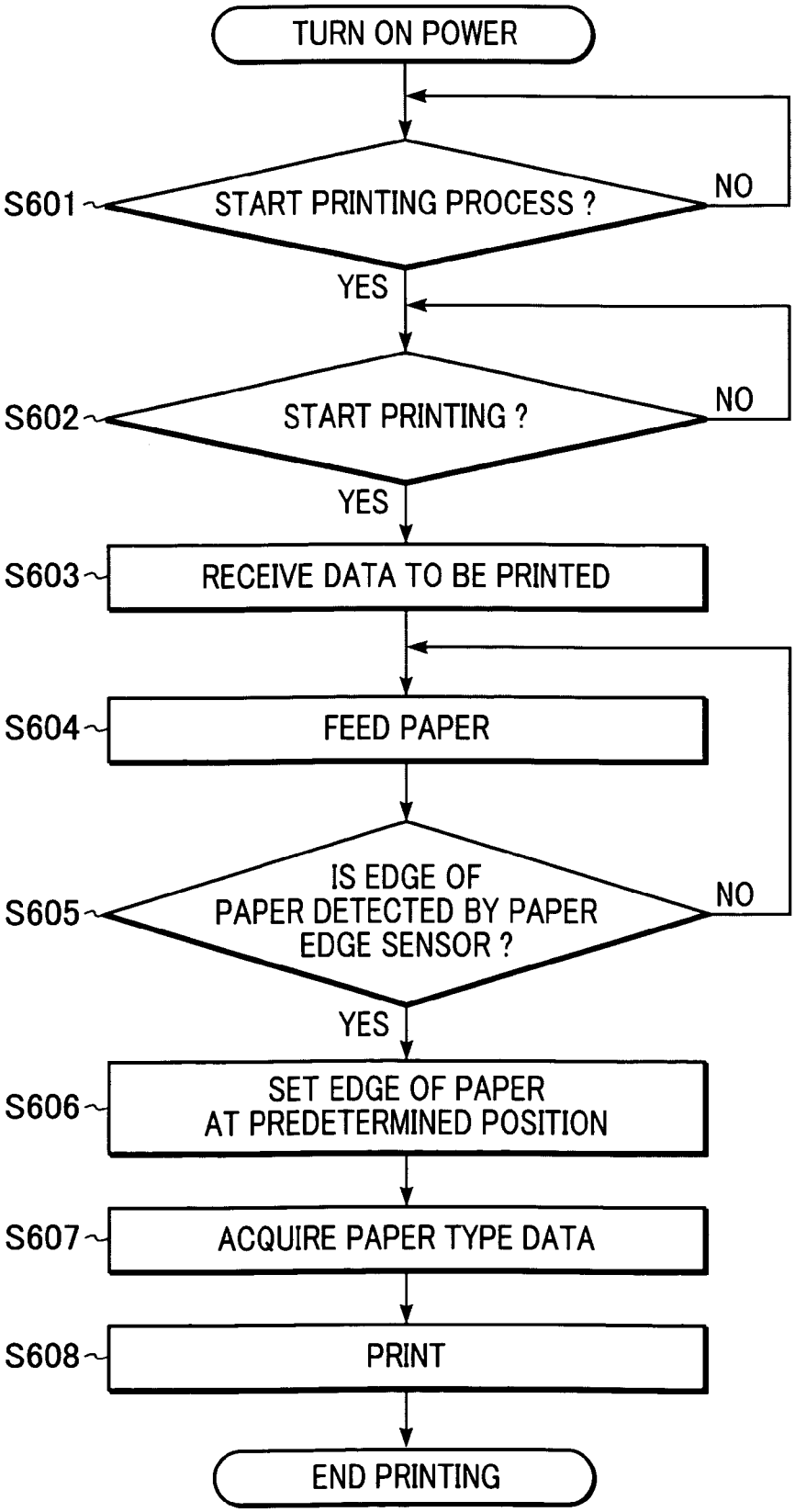
FIG. 7 (PRIOR ART)
FIG. 7 is a flow chart describing a conventional method for identifying type of recording medium.
Figure 8:
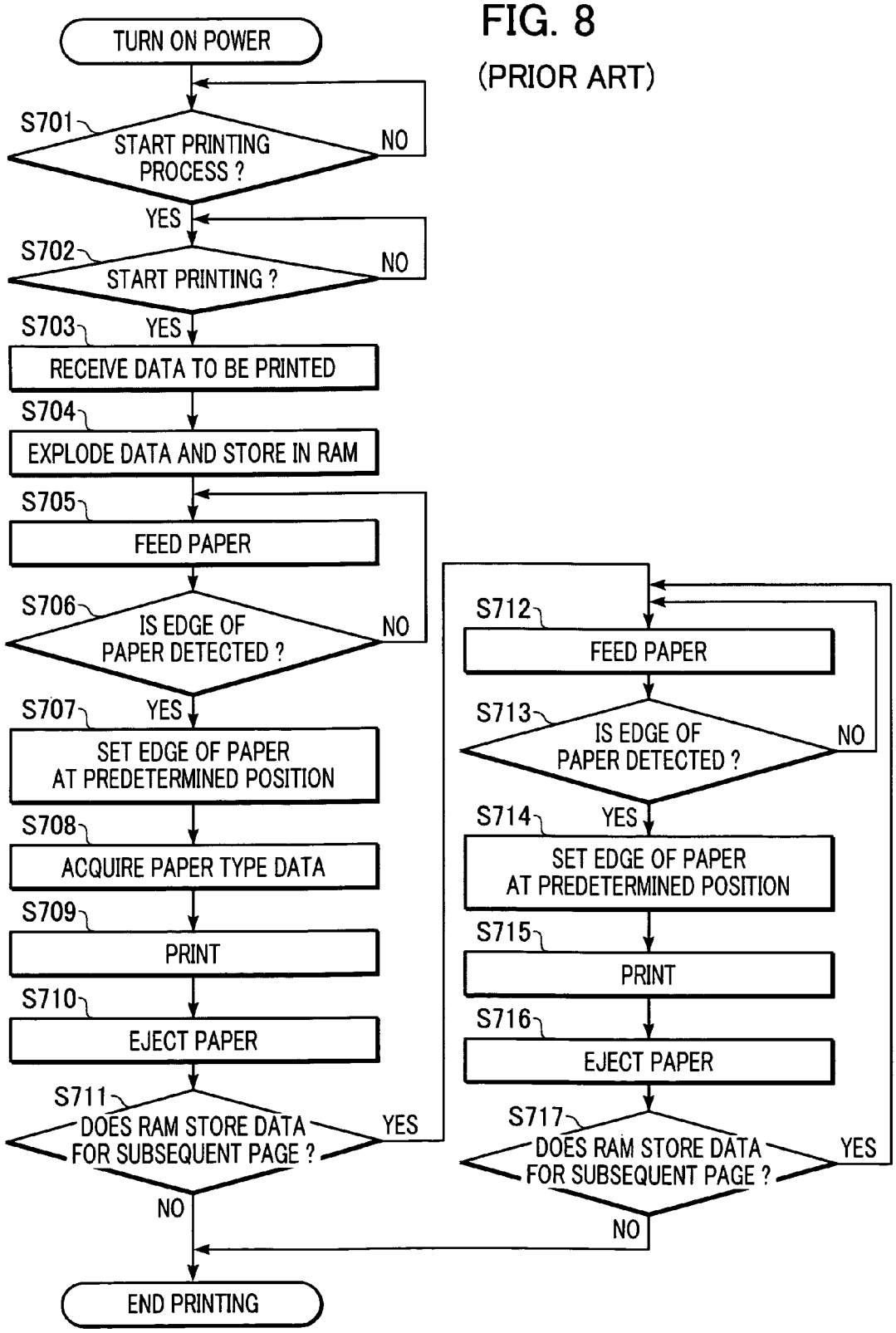
FIG. 8 (PRIOR ART)
FIG. 8 is a flow chart describing the control of a known recording apparatus.

FIG. 5 is a flow chart describing the recording whereby the recording head 1 is moved in the main scanning direction. Data is recorded on the recording medium 19 by driving the recording head 1 by the CR motor 36 to move the carriage 2 including the recording head 1 on the carriage (guiding) axes 4 and 5 (S501 and S502). Steps S501 and S502 are carried out until the data equivalent to one main scanning is recorded (S503). After the data is recorded, the carriage 2 returns to its predetermined position (S504). There are two predetermined positions for the carriage 2 on both sides on the recording medium 19 loaded on the recording apparatus 100. One position is where the carriage 2 returns when scanning is performed in one direction and the other position is where the carriage 2 returns when scanning is performed in the other direction.

When one main scanning is completed, a predetermined length Ln of the recording medium 19 where data has been recorded is delivered further (S111). The predetermined length Ln of the recording medium 19 is about equal to the width of the data recorded on the recording medium 19 by the recording head 1 in the secondary scanning direction (feeding direction).

The recording in Steps S110 and S111 is repeated until the trailing edge of the recording medium 19 is detected by the edge sensor 23. When the edge sensor 23 detects the trailing edge of the recording medium 19 (S112), it is confirmed whether or not the RAM 29 (printer buffer) that stores the data received from the host computer 25 stores data for the next page of the document being recorded and whether or not the next page needs to be recorded (S113).

When there is no subsequent data, the remaining data regarding the document being recorded is printed (recorded) (S120 to S123).

When it is determined in Step S113 that there is data stored for the next page of the document, the type of recording medium 19 loaded on the stacker 15 (i.e., the type of recording medium 19 the next page of the document is going to be recorded on) is acquired by the recording medium-type sensor 42 (S114). After this recording medium-type data is stored in the RAM 30, it is sent to the host computer 25 (S115). Then, the remaining steps of the recording process for the recording being performed on the recording medium 19 are completed (S116 and S117).

After the recording process is completed for the data being recorded and the recording medium 19 is ejected (S118 and S119), the recording process for the next page of the document is started on another recording medium 19.

The recording process for the second recording medium 19 begins by returning to Step S106. The same steps as those carried out for recording the first page of the document on the first recording medium 19 such as feeding action and data preparation are repeated by efficiently using the recording medium-type data acquired in Step S114. Steps S106 to S119 are repeated until the entire document is recorded and the printing is completed.

In the flow chart in FIG. 1, after Step S112 in which the edge sensor 23 detects the trailing edge of the recording medium 19 being used for recording the document, the steps (S113 to S115) for acquiring the data on the type of recording medium 19 that is to be used next for recording the next page of the document and the steps (S116 and S117) for recording the remaining data on the page of the document currently being recording on the recording medium are serially processed. If these steps are processed in parallel so that the steps are smoothly carried out, the time needed for recording may be reduced.

In the flow chart in FIG. 1, when data is recorded on a second or subsequent recording medium 19, the data for the page of the document to be recorded is received and expanded (S106 and S107) after the previous page is ejected (S119). The steps such as receiving the data for the subsequent pages of the document (the data to be recorded on the second and subsequent recording medium 19) (S106 and S107) may be carried out at the same time as the steps for recording the remaining data for the page of the document currently being recorded (S116 to S119).

As described above, according to the first embodiment of the present invention, the recording medium-type data for the recording medium 19 to be used for recording the next page of the document is acquired while recording of the previous page is carried out. Therefore, extra time is not required for acquiring the recording medium-type data for the next recording medium 19 and throughput is improved.

Even if different types of recording media are loaded on the loading unit, the type of recording medium is identified every time a page of the document is recorded on a recording medium. Therefore, the feeding action can be carried out suitably for each type of recording medium and becomes highly reliable. In this way, recording suitable for the type of recording medium may be achieved. More specifically, the recording medium-type data is used for selecting the feeding conditions suitable for the recording medium and for the other steps of the recording process. Thus, fine control becomes possible, and a recording apparatus that is easy to operate for the user may be provided.

Second Embodiment

In the first embodiment, the type of each recording medium 19 used for recording a document is identified when the document includes a plurality of pages and, then, the recording medium-type data is used for achieving recording suitable for the recording medium 19. The second embodiment, on the other hand, identifies the type of every medium of the recording medium when each page is recorded. Then, if the type of recording medium used for a previous recording and the type of recording medium used for a subsequent recording differ, the user is notified that the type of recording medium differs so that the user can decide whether or not to continue the recording. The descriptions of the structures of the recording apparatus and the control system according to the second embodiment are omitted since they are the same as the structures of the first embodiment.

FIG. 6 is a flow chart describing a control process of the recording apparatus according to the second embodiment.

In the flow chart in FIG. 6, the steps from turning on the power to confirming whether or not data for a subsequent page of the document is stored (steps S201–S213) are omitted since they are the same as Steps S101–S113 in the flow chart in FIG. 1.

If it is determined in Step S213 that data for a subsequent page of the document is not stored, the remaining data on the page of the document currently being recorded is printed (recorded) on the remaining portion of the recording medium 19 (S221 to S224).

If it is determined that data for a subsequent page of the document is stored, the remaining data on the page of the document currently being recorded is printed (recorded) on the remaining portion of the recording medium 19, and, then, this recording medium 19 is ejected (S214 to S217).

Next, data on the type of recording medium 19 loaded on the stacker 15 is acquired by the recording medium-type sensor 42 (S218). The recording medium-type data is stored in the RAM 30. Then, the data is sent to the host computer 25 and is used for subsequent recordings. The acquired data on the type of recording medium is stored in the RAM 30 in a region different from the region where the recording medium-type data acquired previously is stored. The region used for storing the recording medium-type data acquired previously refers to the region used for storing the recording medium-type data acquired before recording the first page of the document in Step S202 or, when the document includes a plurality of pages, refers to the region used for storing the recording medium-type data on the recording medium 19 used for recording a previous page of the document.

The type of recording medium 19 to be used for recording a subsequent page of the document acquired in Step S218 and the recording medium-type data acquired previously and stored in the RAM 30 are compared to determine whether or not they are the same (S219). If, in Step 219, the data are determined to be the same, the process returns to Step S208.

If the type of recording medium to be used for recording a subsequent page of the document is determined to be different from the type of recording medium used for recording the previous page in Step S219, the recording is stopped and the user is notified that the types of recording medium differ so that the user can decide whether or not to continue the recording (S220). The method for notifying the user may include showing a dialog on the display of the host computer 25, showing a message on the display of the recording apparatus 100, or illuminating an LED on the recording apparatus 100.

If the user decides not to continue the recording in Step S220, the recording process is ended. If the user decides to continue the recording in Step S220, the recording process is returned to Step S208.

When the process is returned to Step S208, the recording medium-type data acquired in Step S218 is used efficiently for feeding the recording medium, and Step S209 and the subsequent steps are carried out until the printing (recording) is completed after all the pages of the document. At this time, data processing such as disposing the dots may be carried out in accordance with the acquired recording medium-type data and data suitable for the type of recording medium 19 used for recording may be prepared.

In this embodiment, the user is notified that the type of recording medium 19 differs in Step S220 in FIG. 6 so that the user can determine whether or not to continue the recording. The recording apparatus 100, however, may be configured so that the user is notified that the type of recording medium 19 differs and is instructed to load the most suitable type of recording medium 19 on the loading unit. Moreover, the recording apparatus 100 may be configured so that the recording being carried out on the recording medium may be completed, and, then, the recording medium may be ejected. In this way, before the subsequent page of the document is recorded on the next recording medium 19, the recording may be stopped to ask the user to determine whether or not to continue the recording.

In Steps S219 and S220 in FIG. 6, the process is returned to Step S208 when a subsequent page of the document is recorded on the next recording medium 19. Alternatively, the process may be returned to Step 206 to receive image data suitable for the stored recording medium-type data from the host computer 25.

In Step S219 in FIG. 6, the type of recording medium 19 used for recording a previous page of the document and the type of recording medium to be used for recording the next page of the document are compared. In such a case, however, the type of recording medium 19 used for recording the first page of document and the type of recording medium 19 to be used for recording a subsequent page of the document may be compared instead.

In the flow chart in FIG. 6, after Step S212 in which the edge sensor 23 detects the trailing edge of the recording medium being used for recording, the steps (S218 and S219) for acquiring the data on the type of recording medium 19 that will be used for recording the next page of the document and the steps (S214 to S217) for recording the remaining data are serially processed. Alternatively, these steps can be processed in parallel. If the steps are smoothly carried out, the time needed for recording may be reduced.

According to the second embodiment, as described above, when a document including a plurality of pages is recorded, the user might not load enough recording media 19 required for recording the entire document on the loading unit 110. As a result, different types of recording medium 19 might be loaded on the loading unit 110. In such a case, the user is notified that the type of recording medium 19 is different and is asked to decide whether or not to continue the recording. In this way, optimal recording is realized. Moreover, since the stored recording medium-type data can be used for selecting the conditions for feeding the recording medium and for the entire recording process, highly reliable, fine control becomes possible. Thus, a recording apparatus 100 that is easily usable for the user is provided.

Third Embodiment

In the above-mentioned first and second embodiments, whether or not data for a subsequent page of the document is stored in the RAM is confirmed (S112 and S113 of FIG. 1 or S212 and S213 of FIG. 6) after the trailing edge of the recording medium 19 used for recording the previous page of the document is detected. In this embodiment, whether or not data for a subsequent page of the document is stored in the RAM is confirmed before the trailing edge of the recording medium used for recording the previous page of the document is detected. If it is confirmed that data for a subsequent page of the document is stored, the type of the next recording medium is identified.

The type of recording medium to be used for recording a subsequent page of the document can be identified before the trailing edge of the previous recording medium used for recording the previous page of the document is detected by a recording medium-type sensor 42 when a predetermined length of the previous page is delivered. More specifically, in a structure such as those illustrated in FIGS. 2 and 3, even if the trailing edge of the recording medium currently being used for recording is not yet detected, the type of the next recording medium can be detected by the recording medium-type sensor 42 as long as the trailing edge of the recording medium currently being used for recording has passed the position opposing the recording medium-type sensor 42. Therefore, by measuring the remaining length of the recording medium currently being used for recording to be delivered until the trailing edge passes the position opposing the recording medium-type sensor 42 and storing this data in memory, the type of the next recording medium can be identified before the trailing edge of the recording medium currently being used for recording is detected.

According to this embodiment, the recording medium type of a subsequent recording medium is identified while a recording medium is being used for recording. Consequently, after recording on a recording medium is completed, no extra time is required for identifying the type of the subsequent recording medium. In this way, the total time required for recording is reduced and recording suitable for the subsequent recording medium is carried out. When data is recorded on each recording medium in a manner suitable for the recording medium type, less waiting time will be needed for transferring data on one page of the document to a subsequent page of the document and for preparing data if the recording medium type of a subsequent recording medium is identified while the previous recording medium is being used for recording.

By identifying the type of the subsequent recording medium while the previous recording medium is being used for recording, if the recording medium is identified to be a different type of recording medium, the user can be notified at a early stage of the recording process. In such a case, the user can quickly reload the correct type of recording medium without stopping the recording process and the remaining pages of the document can be recorded on the correct type of recording medium.

As described above, according to this embodiment, the recording medium type of a subsequent recording medium can be identified before recording on the previous recording medium is completed. Therefore, throughput is maintained and recording suitable for the type of recording medium can be carried out. Furthermore, a recording apparatus that prevents the throughput from decreasing as much as possible even when a type of recording medium different from the type of recording medium desired by the user is loaded on the loading unit is provided.

According to the structure illustrated in FIG. 3, the recording medium-type sensor 42 is disposed in the vicinity of the feeding roller 14. The recording medium-type sensor 42, however, may be disposed in the vicinity of the trailing edge of the recording medium on the loading unit 110. In this way, the trailing edge of a recording medium passes the position opposing the recording medium-type sensor 42 when only a small amount of the recording media is delivered. Thus, the type of the subsequent recording medium can be identified faster than in the structure illustrated in FIG. 3.

For the first, second, and third embodiments, the method for identifying the recording medium type was applied to a serial printer that moves the inkjet recording head 1 in the main scanning direction and moves the recording medium in the delivery direction. The method, however, may be applied to any recording apparatus such as a line printer having a recording head with a length the same as the width of the recording medium that prints as the recording medium is moved in the delivery direction and is capable of changing its recording conditions in accordance with the type of recording medium used for recording.

In the first, second, and third embodiments, the recording medium on the top of the stack on the loading unit is delivered. The present invention may be applied to a recording apparatus that has a feeding unit that feeds the recording medium on the bottom of the stack. In such a case, however, the recording medium-type identifying unit must be able to identify the type of the recording medium on the bottom of the stack.

According to the present invention, when the document to be recorded includes a plurality of pages, the type of recording medium is identified before recording on the previous recording medium is completed. In this way, throughput is not reduced and recording suitable for the recording medium type is carried out. The acquired recording medium-type data is used for feeding the recording medium and delivery or expanding of the data to be recorded. Consequently, highly reliable recording suitable for the type of recording medium to be used for recording becomes possible.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for recording an image of a document on a recording medium, including first and second recording mediums, comprising:

a loading unit loading the recording medium;

a feed unit feeding the recording medium loaded on the loading unit;

a storage unit storing image data corresponding to the image;

a recording unit recording an image on the recording medium fed by the feed unit; and a discriminating unit discriminating a type of the recording medium, wherein the discriminating unit discriminates the type of the second recording medium after the feed unit feeds the first recording medium by a predetermined length and the storing unit stores image data corresponding to the image to be recorded on the second recording medium.

2. The recording apparatus according to claim 1, wherein the discriminating unit discriminates the type of the second recording medium while the recording unit records the image on the first recording medium.

3. The recording apparatus according to claim 1, wherein the discriminating unit is disposed on the loading unit.

4. The recording apparatus according to claim 3, wherein the discriminating unit discriminates the type of the second recording medium after a trailing edge of the first recording medium is fed pass a position opposing the discriminating unit.

5. The recording apparatus according to claim 1, further comprising a detector unit detecting a trailing edge of the recording medium fed from the loading unit, wherein the discriminating unit discriminates the type of the second recording medium responsive to die detector unit detecting the trailing edge of the first recording medium.

6. The recording apparatus according to claim 1, wherein the discriminating unit discriminates the type of the second recording medium responsive to the document including a plurality of pages.

7. The recording apparatus according to claim 1, wherein the recording unit records the image on the recording medium responsive to the type of the recording medium discriminated by the discriminating unit.

8. The recording apparatus according to claim 1, wherein the discriminating unit discriminates the type of the second recording medium after the recording unit records the image on the first recording medium.

9. The recording apparatus according to claim 8, further comprising a determining unit determining whether the types of the first and second recording mediums are the same.

10. The recording apparatus according to claim 9, further comprising a display displaying a message that the type of the second recording medium differs from the type of the first recording medium responsive to the determining unit determining that the types of the first and second recording mediums are not the same.

11. The recording apparatus according to claim 9, wherein the recording unit stops recording responsive to the determining unit determining that the types of the first and second recording mediums are not the same.

12. The recording apparatus according to claim 9, wherein the recording unit refrains from recording on the second recording medium after recording on the first recording medium responsive to the determining unit determining that the types of the first and second recording mediums are not the same.

13. The recording apparatus according to claim 9, further comprising a memory unit storing data on the type of the first recording medium.

14. A method for operating a recording apparatus including a loading unit loading a recording medium, a recording unit recording an image on the recording medium according to image data, a storing unit storing the image data, and a sensor identifying a type of the recording medium, the method comprising the steps of:

identifying a type of a first recording medium loaded on the loading unit via the sensor;

feeding the first recording medium from the loading unit;

delivering the first recording medium to the recording unit;

recording an image on the first recording medium via the recording unit; and identifying a type of a subsequent recording medium loaded on the loading unit via the sensor after delivering the first recording medium a predetermined length after recording the image on the first recording medium is started and after determining that the storing unit stores the image data corresponding to the image to be recorded on the subsequent recording medium.

15. The method according to claim 14, wherein identifying the type of the subsequent recording medium includes identifying the type of the subsequent recording medium after a trailing edge of the first recording medium passes a position opposing the sensor.

16. The method according to claim 14, further comprising detecting a trailing edge of the recording medium, wherein identifying the type of the subsequent recording medium includes identifying the type of the subsequent recording medium responsive to detecting the trailing edge of the first recording medium.

17. The method according to claim 14, further comprising detecting the trailing edge of the first recording medium, and responsive to detecting the trailing edge of the first recording medium, determining whether image data for recording on the subsequent recording medium is stored in the storing unit.

18. The method according to claim 14, wherein the step of determining whether image data for recording on the subsequent recording medium is stored in the storing unit is performed before detecting the trailing edge of the first recording medium.

19. A recording system comprising:

a recording apparatus including:

a loading unit configured to load a recording medium, including first and second recording media;

a feed unit operable to feed the recording medium loaded on the loading unit;

a storing unit configured to store image data corresponding to an image;

a recording unit operable to record the image onto the recording medium fed by the feed unit;

a discriminating unit configured to discriminate a type of the recording medium;

a host apparatus configured to send image data, which is generated in accordance with the type of the recording medium, to the recording apparatus, wherein the recording apparatus discriminates, via the discriminating unit, the type of the second recording medium after the feed unit feeds the first recording medium by a predetermined length and the storing unit stores image data to record on the second recording medium, the recording apparatus including a control unit controlling sending the discrimination result of the discrimination unit to the host apparatus, and wherein the host apparatus includes:

a generating unit generating new image data corresponding to the type of a received recording medium, when the type of the recording medium of the image data stored in the storing unit and the type of the received recording medium from the recording apparatus are different; and a sending unit sending the image data generated by the generating unit to the recording apparatus.

* * * * *